US005090816A

United States Patent [19]

Socha

[11] Patent Number: 5,090,816

[45] Date of Patent: Feb. 25, 1992

[54] FLUID MIXING DEVICE

[76] Inventor: Thomas Socha, 24 E. Maine St., Johnson City, N.Y. 13790

[21] Appl. No.: 309,524

[22] Filed: Feb. 9, 1989

[51] Int. Cl.[5] ..... B01F 7/22

[52] U.S. Cl. ..... 366/293; 366/309; 366/330; 366/328; 366/605; 366/343; 416/231 A

[58] Field of Search ..... 366/309, 314, 316, 293, 366/605, 330, 328, 343, 67, 312, 292, 298; 416/231 A

[56] References Cited

U.S. PATENT DOCUMENTS

| | | | |
|---|---|---|---|
| 130,473 | 8/1872 | Broughton | 366/328 |
| 948,004 | 2/1910 | Brown | 366/328 |
| 1,001,949 | 8/1911 | Hanna | 416/231 A |
| 1,850,199 | 3/1932 | Bryant | 366/330 |
| 2,086,858 | 7/1937 | Dunkelberger | 366/328 X |
| 2,688,992 | 9/1954 | Russo | 366/328 X |
| 2,799,485 | 7/1957 | Silverman | 366/312 |
| 2,896,925 | 7/1959 | Place | 366/343 X |
| 3,158,359 | 11/1964 | Stiffler | 416/231 A |
| 3,963,220 | 6/1976 | Ohchi | 366/314 X |
| 4,083,653 | 4/1978 | Stiffler | 416/231 A |
| 4,601,583 | 7/1986 | Amorese | 366/330 X |
| 4,721,394 | 1/1988 | Castro et al. | 366/343 |
| 4,880,312 | 11/1989 | Carlson | 366/605 X |

FOREIGN PATENT DOCUMENTS

| | | | |
|---|---|---|---|
| 59-46659 | 11/1984 | Japan | 366/343 |
| 8500 | 4/1908 | United Kingdom | 366/330 |

*Primary Examiner*—Frankie L. Stinson

[57] ABSTRACT

The invention features a mixing device comprising a rotatable impeller having a multiplicity of blades. Each blade of the impeller has an optimal angle of attack with respect to the fluid being mixed.

An elliptical, fluid flow-through aperture in each blade provides for an improved flow stream about the impeller blades. The impeller is mountable upon a rotatable shaft which can be rotatively driven by a household drill.

11 Claims, 1 Drawing Sheet

FLUID MIXING DEVICE

BACKGROUND OF THE INVENTION

This invention relates to a device for mixing and blending fluids such as paint, lacquer, and varnish, epoxies, drive-way sealants, joint compounds, roof coatings and more particularly to a rotatable disc-like impeller for uniformly mixing fluids and high-viscosity materials into a homogeneous condition.

Many different rotatable impellers have been suggested for the mixing and blending of fluids such as paint, lacquer and varnish. Most of these devices work reasonably well in blending the suspended solids in the liquid.

Quite often it is encountered that certain mixtures are more difficult to blend due to heavier components which tend to settle to the bottom, and escape the mixing vortices created by the rotating impeller blades. Also, it is often experienced that containers in which fluids have been stored for a considerable length of time, have deposits which have settled to the bottom. These bottom deposits are most difficult to raise from the bottom, and even high speed impellers encounter difficulty in providing mixing homogeneity to such liquids.

Impellers are generally designed to provide turbulent vortices within the fluid, which vortices create an upward flow of bottom components.

It has been observed that large molecular weight components, having higher viscosities, often resist this turbulent flow. Thus, even high speed mixing devices have problems with heavy bottom components.

This invention has discovered than an improved blending current could be created within the fluid, by allowing a smoother fluid flow-through to develop between the rotating blades of the mixing impeller. In other words, it has been discovered that a finer blending could occur if the flow stream moved rapidly through, as well as around, the rotating blades.

It has been further discovered that this smoother flow-through provided the blade designer with an additional advantage, wherein the angle of attack between the impeller blades and the fluid could be increased without a substantial increase in rotative driving power.

Increasing the blade angle to 15° without requiring excessive driving horsepower, allows the impeller of the present invention to be mounted upon almost any low-power, household drill.

The present invention also provides the impeller blades to contiguously come into contact with the bottom wall of the container despite the higher blade angle of attack. This improves the ability of the blades to lift stubborn bottom components and force them into the mixing stream. This contiguous contact is achieved by beveling the trailing circumferential edge of each impeller blade, wherein each blade rides over the bottom wall of the container.

DISCUSSION OF RELATED ART

A device for blending coloring agents into oleomargin is illustrated in the U.S. Pat. No. 2,274,485 to Janssen; issued: Feb. 24, 1942. The aforementioned mixing device features a number of impeller discs mounted upon a rotatable, hand-cranked shaft. The disc blades have alternating angles of attack with respect to the fluid, such that a "worm-type" feed is created within the mixing chamber. The blades provide for changes in flow-through in the blades by means defining a plurality of circular holes of different size.

The present invention while embracing some of the design principles of the above-mentioned device, has different flow objectives, and has designed the mixing blades for linear rather than a turbulent -type flow stream.

The impeller of the invention has uniform elliptical flow-through apertures, which are designed to accommodate high speed flow-through. The angle of attack of each mixing blade of the invention impeller is disposed in the same direction to create centralized mixing vortices. The centralized vortex create a lifting of the heavier components from the bottom of the liquid mixture.

SUMMARY OF THE INVENTION

The invention pertains to a mixing device for stirring and blending fluids. The device comprises a disc-like impeller having a multiplicity of blades which are integrally formed for mounting upon a rotatable shaft. Each blade in the impeller extends radially outwardly from the axis of the shaft. An elliptical hole is provided in each blade for allowing fluid flow-through as each blade attacks the liquid. The blades each have a 15°±2° angle of attack with respect to the fluid and the shaft axis. A forward circumferential edge of each blade is rounded for streamlining the fluid flow, while a trailing circumferential edge terminates in a beveled cut with respect to the radial axis.

It is a object of this invention to provide an improved mixing device;

It is another object of the invention to provide a mixing device that has increased fluid flow-through in the impeller blades;

These and other objects of this invention will become more apparent and will be better understood with reference to the subsequent detailed description considered in conjunction with the accompanying drawings.

DESCRIPTION OF THE PREFERRED EMBODIMENT

Generally speaking, the invention relates to a mixing and blending device for paints, lacquers and varnish, but is not limited thereto. In particular, the impeller blade of this invention can blend extremely hard to mix substances of unusually high viscosity such as: joint compounds, roofing coatings and drive-way sealants. The device comprises an impeller that is mounted to a rotatable shaft which is rotatively driven by a household drill or similar motorized power source. The impeller has a disc-like appearance.

For the sake of brevity like elements and components will be given the same designation throughout the figures.

Figure 1:
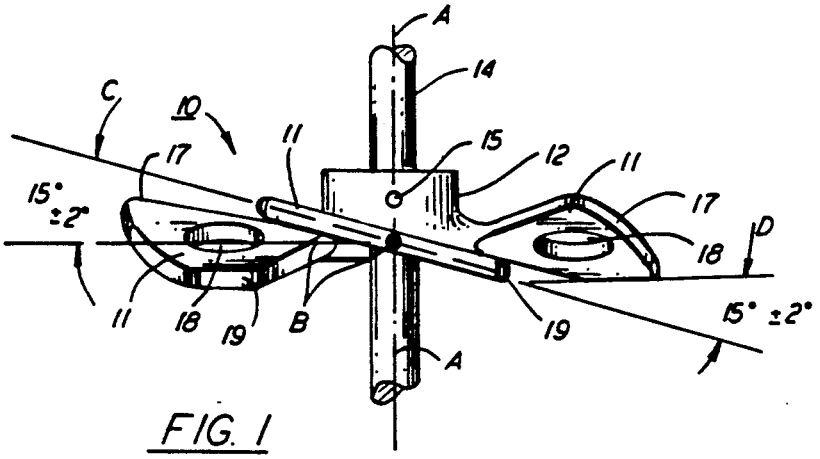
FIG. 1 is a side view of the mixing impeller of the invention.
Figure 2:
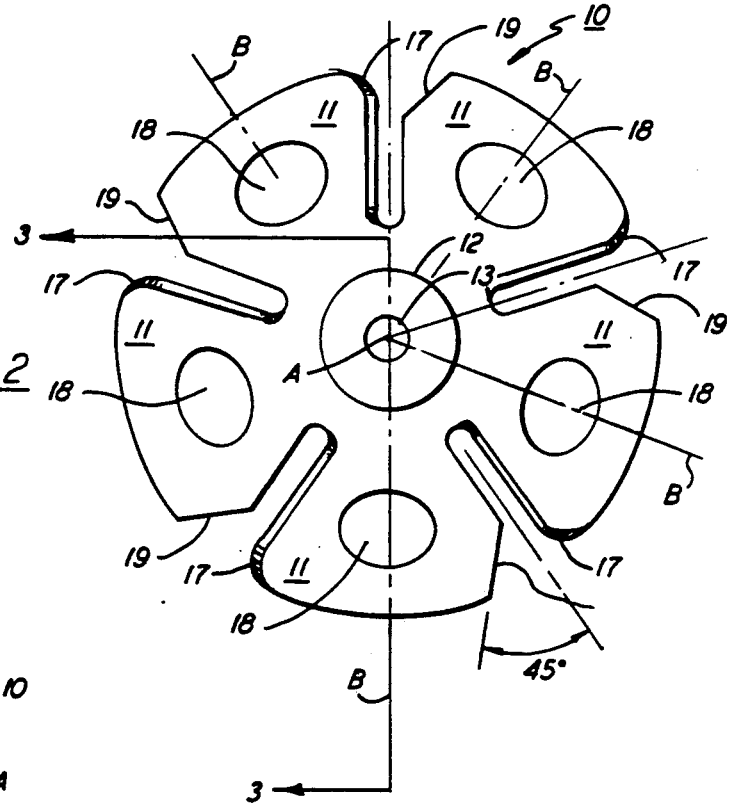
FIG. 2 is a top view of the mixing impeller of FIG.
Figure 3:
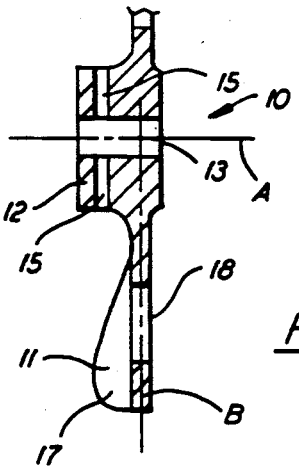
FIG. 3 is a partial sectional view cut along the center of the inventive impeller of FIG. 1.

Now referring to FIG. 1, the mixing impeller 10 of this invention is illustrated. The impeller 10 comprises five blades 11 (typical) which are integrally formed about a hub section 12. The hub section 12 has a bore hole 13, (FIGS. 2 and 3) for receiving a rotatable shaft 14. The bore hole 13 and shaft may be round or have a hexagonal cross-section to prevent rotational slippage. A pin-hole 15 disposed in the hub section 12 provides for the insertion of a pin or screw (not shown) for fastening the hub section 12 to the rotatable shaft 14.

Each blade 11 extends radially outwardly along a radial axis "B" (typical), which is perpendicular to the shaft axis "A".

Each blade 11 is angled into the flow stream at an angle of attack "C" (FIG. 1), which is 15°±2° with respect to the radial axis "B".

Each blade 11 has an elliptical flow-through hole 18 (typical) disposed in a mid-portion thereof.

Each blade 11 has a forward circumferential edge 17 (typical), which is rounded to provide streamlining to the blade 11, such that each blade 11 can more easily move through the fluid to be mixed.

Each blade 11 has a trailing circumferential edge 19 (typical), which is beveled cut at an angle "D" of 15°±2° with respect to the angle of attack. By providing this beveled cut in each blade 11, the impeller 10 is allowed to rest flush with a bottom wall 21 (FIG. 4) of the container 22 housing the fluid 23 to be mixed. In this respect, the impeller 10 can scrape and lift bottom sediments and heavier mixture elements, which have settled to the bottom of container 22, thus providing improved mixing action for these heavier elements.

Figure 4:
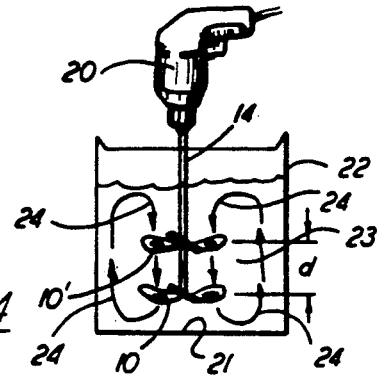
FIG. 4 is a schematic in situ view of the invention mixing a fluid disposed inside a container.

The elliptical hole improved fluid flow-through in each respective blade 11, such that the fluid flows around and through the blades 11 creating the fluid vortices (arrows 24) in the fluid 23, as illustrated in FIG. 4.

As a result, a blending flow is created which requires less power to rotatively drive shaft 14.

In addition, each blade is set at an optimal angle of attack "C", such that blending of the fluid components is accomplished in a more facile manner, i.e., the blending stream defined by the vortex 24 has a more linear, rather than turbulent flow characteristic. This also prevents splattering in the mixing process.

Referring to FIG. 4, the impeller 10 is shown mounted upon a rotatable shaft 14, which is rotatively driven by a household drill 20. The efficiency of the impeller blade 10 is evidenced by the fact that any normally mixable fluid can be blended by a ⅜" drill. The impeller blade 10 is also capable of mixing substances which are not mixed by this method, such as: roofing coatings, asphalts, coal tar, bitumen, drive-way sealants, joint compounds, etc. Joint compounds can be thoroughly blended in 35 seconds by a heavy-duty ⅜" Black & Decker drill. The shaft 14 can also accommodate another, identical impeller 10′ which is spaced-apart from impeller 10 by a distance "d". A good separation distance "d" has been found to be about 4 to 5 inches.

As aforementioned, the impeller 10 is able to fit flush against the bottom wall 21 of container 22. Thus, the sediments in fluid 23 are lifted from the bottom of container 22.

Added impeller 10′ provides for a more directed flow, and improves the linearity of the blending stream.

The disc-like impeller 10 can be made of impact-resistant polypropylene.

Having thus described the invention, what is desired to be protected by Letters Patent is presented by the subsequently appended claims.

What is claimed is:

1. A mixing device for stirring and blending fluids, comprising a disc-like impeller having a multiplicity of blades integrally formed for mounting upon a rotatable shaft defined by a vertical shaft axis, each of said blades extending radially outwardly along a radial axis which is substantially perpendicular with respect to said shaft axis, means defining a hub portion of said impeller for affixing the impeller to said rotatable shaft, means defining a substantially elliptical hole in each of said blades for allowing fluid flow-through as each blade attacks the fluid, each of said blades having a 15°±2° angle of attack with respect to said fluid and said radial axis, each blade further having a forward, circumferential edge which is rounded and a trailing circumferential edge which is terminated in a beveled cut with respect to said radial axis, and wherein said beveled cut allows said trailing circumferential edge to rest flush on a bottom wall of a container housing said fluid to be mixed.

2. The mixing device of claim 1, wherein each beveled cut in angled at approximately 15°±2° with respect to said angle of attack.

3. The mixing device of claim 1, wherein said disc-like impeller has five blades.

4. The mixing device of claim 1, wherein there are two spaced-apart, disc-like impellers mounted upon said shaft.

5. The mixing device of claim 4, wherein said two impellers are separated upon said shaft in a range from approximately 4 to 5 inches.

6. The mixing device of claim 1, wherein said disc-like impeller comprises polypropylene.

7. The mixing device of claim 1, wherein said disc-like impeller comprises non-porous plastic.

8. The mixing device of claim 1, wherein each elliptical hole is disposed in a mid-portion of each respective blade.

9. The mixing device of claim 1, wherein each of said forward, circumferential edges provide streamlining to allow said fluid to flow more easily past each respective blade, and furthermore, to prevent blade penetration into a container wall.

10. The mixing device of claim 9, wherein said forward circumferential edges have a radius of approximately 0.32 to 0.35 R, where R is the radius of the entire disc-like impeller.

11. A mixing device for stirring and blending fluids, comprising two spaced-apart, disc-like impellers having a multiplicity of blades integrally formed for mounting upon a rotatable shaft defined by a vertical shaft axis, each of said blades of each impeller extending radially outwardly along a radial axis which is substantially perpendicular with respect to said shaft axis, means defining a hub portion of said impeller for affixing the impeller to said rotatable shaft, means defining a substantially elliptical hole in each of said blades for allowing fluid flow-through as each blade attacks the fluid, each of said blades having a 15°±2° angle of attack with respect to said fluid and said radial axis, each blade further having a forward circumferential edge which is rounded and a trailing circumferential edge which is terminated in a beveled cut with respect to said radial axis, and wherein said beveled cut allows said trailing circumferential edge to rest flush on a bottom wall of a container housing said fluid to be mixed.

* * * * *